US007629096B2

(12) United States Patent
Suzuki et al.

(10) Patent No.: US 7,629,096 B2
(45) Date of Patent: Dec. 8, 2009

(54) ELECTROPHOTOGRAPHIC PHOTORECEPTOR WITH AN UNDERCOAT LAYER CONTAINING A POLYIMIDE RESIN AND ELECTROPHOTOGRAPHIC APPARATUS WITH THE PHOTORECEPTOR

(75) Inventors: Hajime Suzuki, Kofu (JP); Tadayoshi Uchida, Kofu (JP); Ryoji Kobayashi, Kofu (JP)

(73) Assignee: Yamanashi Electronics Co., Ltd., Yamanashi (JP)

( * ) Notice: Subject to any disclaimer, the term of this patent is extended or adjusted under 35 U.S.C. 154(b) by 468 days.

(21) Appl. No.: 10/584,348

(22) PCT Filed: Dec. 21, 2004

(86) PCT No.: PCT/JP2004/019063

§ 371 (c)(1),
(2), (4) Date: Jun. 23, 2006

(87) PCT Pub. No.: WO2005/064415

PCT Pub. Date: Jul. 14, 2005

(65) Prior Publication Data

US 2007/0148574 A1 Jun. 28, 2007

(30) Foreign Application Priority Data

Dec. 26, 2003 (JP) ..... 2003-434462

(51) Int. Cl.
*G03G 5/14* (2006.01)
*G03G 5/047* (2006.01)

(52) U.S. Cl. ..... 430/58.85; 430/60; 430/64; 399/159

(58) Field of Classification Search ..... 430/58.85, 430/65, 64, 60; 399/159
See application file for complete search history.

(56) References Cited

U.S. PATENT DOCUMENTS 5,677,096 A 10/1997 Suzuki
6,447,965 B1 * 9/2002 Nakamura et al. ..... 430/59.5
6,869,740 B2 * 3/2005 Shindoh et al. ..... 430/58.85

FOREIGN PATENT DOCUMENTS

JP 830007 2/1996
JP 9146288 6/1997
JP 10123737 5/1998
JP 2002196519 A * 7/2002
JP 2002229236 8/2002
JP 2002244320 8/2002
JP 200315332 1/2003
JP 2003043715 A * 2/2003
JP 200366636 3/2003

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*
Machine translation of JP 2002-196519 (Jul. 2002).*
Machine translation of JP 2003-043715 (Feb. 2003).*
Machine translation of JP 08-030007 (Feb. 1996).*
PCT International Search Report dated Mar. 1, 2005.

* cited by examiner

*Primary Examiner*—Christopher RoDee
(74) *Attorney, Agent, or Firm*—Dickinson Wright PLLC

(57) ABSTRACT

An electrophotographic photoreceptor that without detriment to excellent electrophotographic performance, realizes coating of any defects on a conductive substrate and excels in repetition stability and environmental performance. There is provided an electrophotographic photoreceptor having a photoreceptive layer superimposed via an undercoat layer on a conductive support, characterized in that the undercoat layer contains a polyimide resin and that at least one of the compounds of the following formulae is contained as a charge transfer agent of the photoreceptive layer.

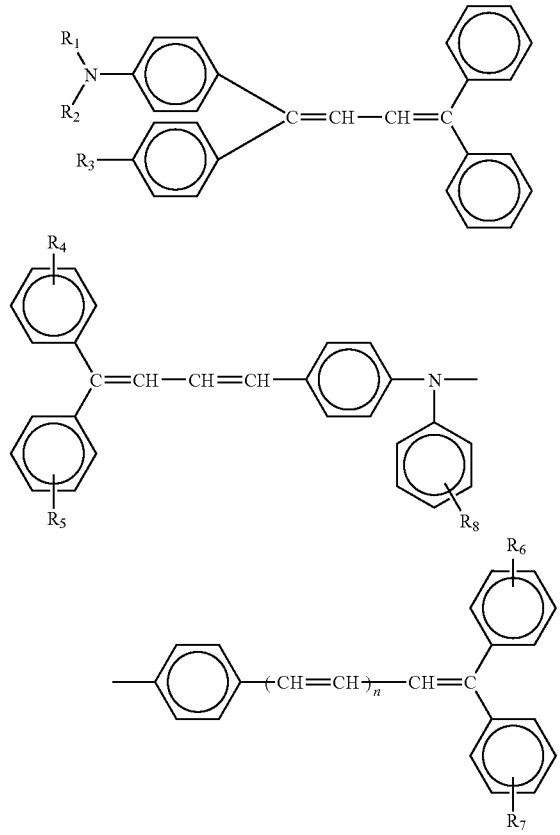

12 Claims, No Drawings

ELECTROPHOTOGRAPHIC PHOTORECEPTOR WITH AN UNDERCOAT LAYER CONTAINING A POLYIMIDE RESIN AND ELECTROPHOTOGRAPHIC APPARATUS WITH THE PHOTORECEPTOR

TECHNICAL FIELD

The present invention relates to an electrophotographic photoreceptor used for electrophotographic apparatuses such as copying machines, LED, LD printers, etc. and particularly to an electrophotographic photoreceptor which has an undercoat layer and uses an organic photoconductive material, and an electrophotographic apparatus provided with the photoreceptor.

BACKGROUND ART

In general, an electrophotographic process using a photoreceptor is performed in the following manner. That is, the photoreceptor is charged in the dark by a charging roller in the case of, for example, contact charging method, and then exposed using LED or LD as an imagewise exposing means to selectively dissipate the charge in only the exposed areas to form an electrostatic latent image, which is rendered visible with a developer to form an image.

Fundamental properties required for the electrophotographic photoreceptors are such functions that they can be charged to a proper potential in the dark and the surface charge can be dissipated by irradiation with light.

Electrophotographic photoreceptors which are now put to practical use basically comprise a conductive support and a photosensitive layer formed thereon. However, these photoreceptors suffer from the problems that when an aluminum tube as a conductive support is subjected to cutting process by a diamond cutting tool or the like, cutting oil or powders formed by cutting remain on the support and appear as defects in formation of images after the photosensitive layer is coated on the support or when a high voltage is applied to the surface of the photoreceptor, current flows into the photoreceptors through the defects such as cutting burrs and deposited dirt or foreign matters to result in partial short-circuits. Furthermore, they appear as image defects such as dusts and fogs. Moreover, the charge generation layer formed on the conductive substrate has a thickness of about 1 μm, and is influenced by these defects to adversely affect the functions as a photoreceptor.

For inhibition of adverse effects caused by the defects on the surface of the conductive substrate, there is usually employed a method of covering the defects on the conductive substrate by providing an Alumite coat (anodized aluminum coat) on the substrate by anodizing treatment or by providing an undercoat layer using resin materials.

However, the Alumite coat has the disadvantages such as inclusion of dirt in the fine pores formed on the surface of the Alumite coat during the process of production and contamination of the surface of the Alumite coat caused at the sealing step of pores or cleaning step. Thus, even if the defects on the surface of the conductive substrate are covered, contamination of the Alumite coat per se adversely affects the photoreceptor.

It is known that resin materials such as polyethylene, polypropylene, polystyrene, acrylic resin, vinyl chloride resin, vinyl acetate resin, polyurethane resin, epoxy resin, silicone resin and polyamide resin are used for the undercoat layer. Of these resins, polyamide resins are particularly preferred.

However, in the case of an electrophotographic photoreceptor in which polyamide resin or the like is used for the undercoat layer, since the volume resistivity of the photoreceptor is about $10^{12}$-$10^{15}$ Ω·cm, residual potential is accumulated in the photoreceptor unless the undercoat layer is made thin to 1 μm or less in thickness, and dusts or fogs occur in the resulting images. On the other hand, if the undercoat layer is thin, not only the defects on the conductive support cannot be covered, but also injection of holes from the substrate is accelerated during repeated use to cause considerable reduction of charging potential and decrease of light sensitivity, resulting in formation of dusts and fogs in the image to damage the image quality.

An undercoat layer is proposed which comprises a polyimide resin soluble in an organic solvent and has a thickness of 0.5 μm (e.g. Patent Document 1).

Patent Document 1: JP-A-8-30007

However, it has been found that in the case of combining the conventional charge transport agent with the undercoat layer comprising a polyimide resin and having a thin thickness of less than 1.0 μm as disclosed in Patent Document 1, the residual potential after repeated use of the photoreceptor increases, resulting in dusts and fogs in the image.

Furthermore, in the case of the electrophotographic apparatus provided with a contact charging member which applies a charging voltage by directly contacting the undercoat layer with photoreceptor, a high voltage is directly applied to the electrophotographic photoreceptor, and hence dusts and fogs are often generated.

DISCLOSURE OF INVENTION

Problem to be Solved by the Invention

The object of the present invention is to provide an electrophotographic photoreceptor which is excellent in repetition stability and environmental characteristics by covering the defects on the conductive substrate without damaging the excellent electrophotographic characteristics.

Means for Solving the Problem

As a result of intensive research conducted by the inventors in an attempt to solve the above problems, it has been found that an electrophotographic photoreceptor comprising a conductive support and a photosensitive layer provided thereon, with an undercoat layer provided therebetween, is free from the above problems in conventional technologies and maintains excellent electrostatic characteristics over a long period of time if the undercoat layer contains a specific polyimide resin and a specific charge transport agent. Thus, the present invention has been accomplished.

That is, the present invention relates to an electrophotographic photoreceptor comprising a conductive support and a photosensitive layer formed on the conductive support, with an undercoat layer provided between the conductive support and the photosensitive layer, characterized in that the undercoat layer contains a polyimide resin and the photosensitive layer contains at least one of the compounds represented by the following formula [I] and [II] as a charge transport agent:

Formula [I]

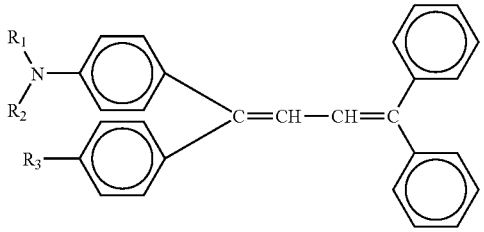

(in the above formula, $R_1$ and $R_2$ independently represent an alkyl group having 1-6 carbon atoms which may have a substituent, and $R_3$ represents a hydrogen atom or a dialkylamino group in which at least one of the alkyl groups has 2 or more carbon atoms), Formula [II]

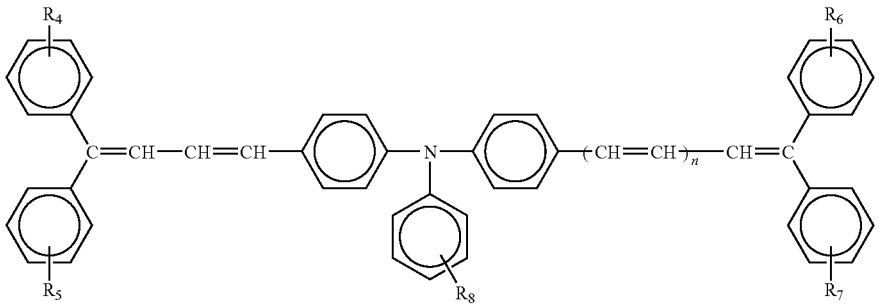

(in the above formula, $R_4$-$R_7$ may be the same or different and independently represent a hydrogen atom, a halogen atom, an alkyl group or alkoxy group having 1-6 carbon atoms or an aryl group which may have a substituent, $R_8$ represents a hydrogen atom, a halogen atom, an alkyl group or alkoxy group having 1-6 carbon atoms, an aryl group which may have a substituent, an alkenyl group or alkadienyl group which may have a substituent or a group represented by the following formula [II'], and n represents an integer of 0 or 1), Formula [II']

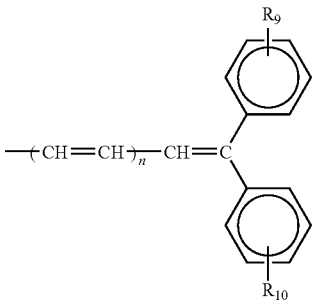

(in the above formula, $R_9$ and $R_{10}$ may be the same or different and independently represent a hydrogen atom, a halogen atom, an alkyl group or alkoxy group having 1-6 carbon atoms or an aryl group which may have a substituent, and n represents an integer of 0 or 1).

According to an aspect of the invention having the above construction, the defects of the conductive support such as pin holes can be covered and furthermore increase of residual potential after repeated use can be inhibited and generation of dusts and fogs on the image can be prevented.

Another aspect of the invention relates to an electrophotographic photoreceptor, wherein the undercoat layer contains a polyimide resin represented by the following formula [III].

Formula [III]

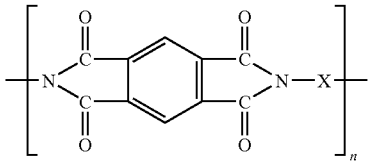

(in the formula, X is a divalent polycyclic aromatic group in which the aromatic rings may be linked by a hetero-atom and n is an integer which shows a polymerization degree).

According to another aspect of the invention, increase of residual potential after repeated use can be inhibited.

Another aspect of the invention relates to an electrophotographic photoreceptor, wherein the undercoat layer has a thickness of 1.0-50 in.

According to another aspect of the invention, even relatively large defects on the conductive support can be covered and the resulting image is free from defects.

Another aspect of the invention relates to an electrophotographic photoreceptor, wherein the undercoat layer contains titanium oxide, whereby the permittivity of the undercoat layer can be enhanced and dispersibility is also improved.

Moreover, it is preferred that the weight ratio of the polyimide resin and the titanium oxide is in the range of 2:1-1:4.

Another aspect of the invention relates to an electrophotographic photoreceptor, wherein the undercoat layer has a two-layer structure comprising a layer containing a polyimide resin represented by the formula [I] and a layer comprising a thermosetting resin or a thermoplastic resin provided on the layer containing polyimide resin, whereby even if the undercoat layer is thick, accumulation of the residual potential can be inhibited and chargeability can be stabilized, resulting in improvement in image quality.

Another aspect of the invention relates to an electrophotographic photoreceptor, wherein a tube which is not subjected to cutting process is used as the conductive support, whereby the defects on the surface of the conductive support can be surely covered.

Another aspect of the invention relates to an electrophotographic apparatus, wherein a contact charging means is provided as a charging means, whereby the object of the present invention can be attained.

Another aspect of the invention relates to an electrophotographic apparatus, wherein an exposing section using a semiconductor laser is used, whereby the problem of interference fringes in the image can be solved.

ADVANTAGES OF THE INVENTION

In the electrophotographic photoreceptor of the present invention, the electrostatic characteristics such as surface potential and potential after exposure are not greatly deteriorated even after repeated use, no image defects occur and repetition stability is high.

Therefore, according to the present invention, there can be provided an electrophotographic photoreceptor which has excellent electrophotographic characteristics, cleanability and oil resistance and can be simplified in its maintenance.

The preferred embodiments of the electrophotographic photoreceptor according to the present invention will be explained in detail below.

The present invention is applied to, for example, a double-layered type electrophotographic photoreceptor comprising a conductive support, a charge generation layer containing at least a charge generation agent and formed on the support, and a charge transport layer containing at least a charge transport agent formed on the charge generation layer. In this case, the photosensitive layer is formed of the charge generation layer and the charge transport layer.

Furthermore, the present invention can also be applied to a monolayer type electrophotographic photoreceptor in which the charge generation agent and the charge transport agent are contained in the same layer or an inversely laminated type electrophotographic photoreceptor in which the charge transport layer is first formed and thereafter the charge generation layer is laminated thereon.

As the conductive support usable in the present invention, various materials having electrical conductivity can be used with no limitation in the kind and shape thereof, and examples of the materials are worked pieces of metals or alloys thereof such as aluminum, brass, stainless steel, nickel, chromium, titanium, gold, silver, copper, tin, platinum, molybdenum and indium, plastic sheets or films to which electrical conductivity is imparted by vacuum deposition or plating of the above metals or conductive materials such carbon, conductive glasses made by coating with tin oxide, indium oxide or aluminum iodide, and the like. As for the shape of the conductive supports, there may be used those which have a shape of drum, rod, plate, sheet or belt.

Among them, suitable are aluminum alloys of JIS3000 series, JIS5000 series, JIS6000 series, etc., which are shaped by general methods such as EI method, ED method, DI method, and II method, and preferred are uncut tubes which are not subjected to surface cutting process using a diamond cutting tool and surface treatment such as abrasion or anodizing treatment.

The charge generation agents usable in the present invention are preferably disazo pigments and oxytitanium phthalocyanine because they have good affinity in sensitivity, but the present invention is not limited to these charge generation agents. Other examples are selenium, selenium-tellurium, selenium-arsenic, amorphous silicon, metal-free phthalocyanine, other metal phthalocyanine pigments, monoazo pigments, trisazo pigments, polyazo pigments, indigo pigments, threne pigments, toluidine pigments, pyrazoline pigments, perylene pigments, quinacridone pigments, polycyclic quinone pigments, pyrylium salts, etc. Particularly, oxytitanium phthalocyanine is reported to have many crystal forms, and especially preferred for the electrophotographic photoreceptor of the present invention are a crystal form showing a maximum diffraction peak at a Bragg angle ($2\theta \pm 0.2°$) of 27.3° in X-ray diffraction spectrum when measured using CuKα as a radiation source, a crystal form showing main peaks at 7.6° and 28.3°, and a crystal form showing a maximum peak at 7.5° and having other diffraction peak intensity of not higher than 20% of the diffraction peak intensity at 7.5°. The thickness is 0.01-5.0 μm, preferably 0.1-1.0 μm.

The charge generation agent may be used each alone or in admixture of two or more for obtaining proper light sensitivity wavelength or sensitization action.

The undercoat layer in the present invention may contain an intermediate before polyimidation, and the mixing ratio of the polyimide precursor and the polyimide resin is such that the polyimide resin is contained in an amount of suitably 20-70%, preferably 30-50% based on the total weight of the polyimide resin and the polyimide precursor. If the content of the polyimide resin is less than 20%, the undercoat layer dissolves in the organic solvent, and if it is more than 70%, the intermediate is in nearly imidated state, resulting in accumulation of residual potential after repeated use and deterioration in image quality.

The molecular weight of the polyimide resin is preferably 1,000-100,000, especially preferably 10,000-30,000. Examples of X are as follows.

[X-1]

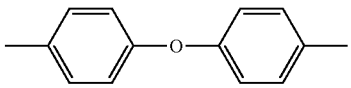

[X-2]

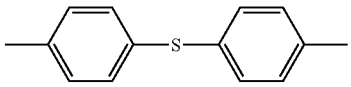

[X-3]

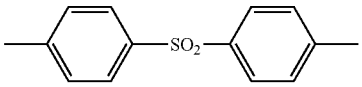

In the electrophotographic photoreceptor of the present invention comprising a conductive support and a photosensitive layer formed on the support, with an undercoat layer provided therebetween, the undercoat layer contains a polyimide resin represented by the formula [I] whereby film formability is improved, defects such as pin holes on the conductive support can be covered even when the layer is thin, and the photosensitive layer is superior in barrier function and adhesion function. The thickness is 1.0-50 μm, preferably 20-40 μm.

The drying temperature in formation of the undercoat layer is suitably 110-170° C., preferably 130-150° C. If it is lower than 110° C., the undercoat layer dissolves in the solvent and hence cannot be coated on the photoreceptor. If the undercoat layer is dried at 110° C. or higher, it does not dissolve in the organic solvent. If the drying temperature is higher than 170° C., the residual potential after repeated use increases to cause change in image density.

Further, when the undercoat layer has a two-layer structure comprising a layer containing a polyimide resin represented by the formula [I] and a layer comprising a thermosetting resin or a thermoplastic resin provided thereon, even if the thickness of the undercoat layer increases, the accumulation of residual potential can be inhibited and besides quality of image is improved.

In the electrophotographic photoreceptor of the present invention, the undercoat layer may contain titanium oxide. The surface of titanium oxide particles used in the present invention may be subjected to various treatments so long as they do not reduce volume resistivity. For example, the particle surface can be coated with an oxide film using aluminum, silicon, nickel or the like as a treating agent. In addition, if necessary, water repellency can be imparted to the particles using a coupling agent or the like. The average particle diameter of the titanium oxide is preferably 1 μm or less, more preferably 0.01-0.5 μm. The content of the titanium oxide is preferably 0.5-4 when the amount of polyimide is assumed to be 1.

Furthermore, the undercoat layer may have a two-layer structure of a layer comprising a polyimide resin and a layer comprising a thermosetting resin or a thermoplastic resin provided thereon. As the thermosetting resin, mention may be made of epoxy resin, polyurethane resin, phenolic resin, melamine-alkyd resin, unsaturated polyester resin, etc. As the thermoplastic resin, mention may be made of syrene-based elastomers, olefin-based elastomers, urethane-based elastomers, polyvinyl chloride-based elastomers, etc. The thickness of the resin layer provided on the polyimide resin layer is 0.1-10.0 μm, preferably 0.8-5.0 μm.

Both or one of the two layers may contain a white pigment for the purpose of inhibiting interference of light during exposure by semiconductor laser. Examples of the white pigment are titanium oxide, zinc oxide, silica, etc.

Binder resins used for the formation of the photosensitive layer include, for example, photosetting resins such as polycarbonate resin, styrene resin, acrylic resin, styrene-acryl resin, ethylene-vinyl acetate resin, polypropylene resin, vinyl chloride resin, chlorinated polyether, vinyl chloride-vinyl acetate resin, polyester resin, furan resin, nitrile resin, alkyd resin, polyacetal resin, polymethylpentene resin, polyamide resin, polyurethane resin, epoxy resin, polyarylate resin, diarylate resin, polysulfone resin, polyether sulfone resin, polyallyl sulfone resin, silicone resin, ketone resin, polyvinyl butyral resin, polyether resin, phenolic resin, EVA (ethylene•vinylacetate copolymer) resin, ACS (acrylonitrile•chlorinated polyethylene•styrene) resin, ABS (acrylonitrile•butadiene•styrene) resin, and epoxy arylate. These may be used each alone or in admixture of two or more. Moreover, when resins differing in molecular weight are used in admixture, hardness and abrasion resistance can be improved, which is more preferred.

As the charge transport agent used in the present invention, preferred are compounds shown by the formulas [V] and [VI] among the compounds included in those of the formula [I].

Formula [V]

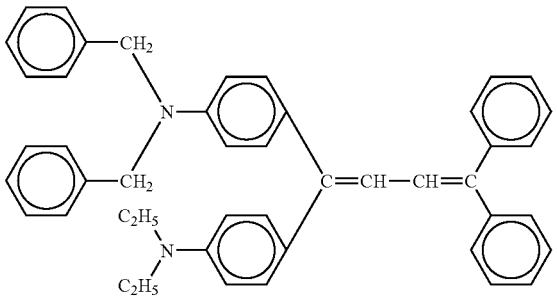

Formula [VI]

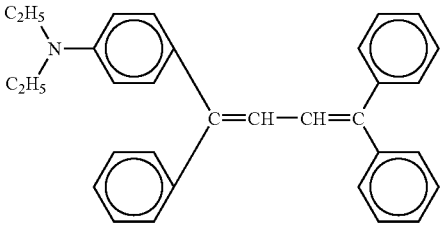

Furthermore, among the compounds of the formula [II], preferred are those represented by the formulas [VII], [VIII], [IX] and [X].

Formula [VII]

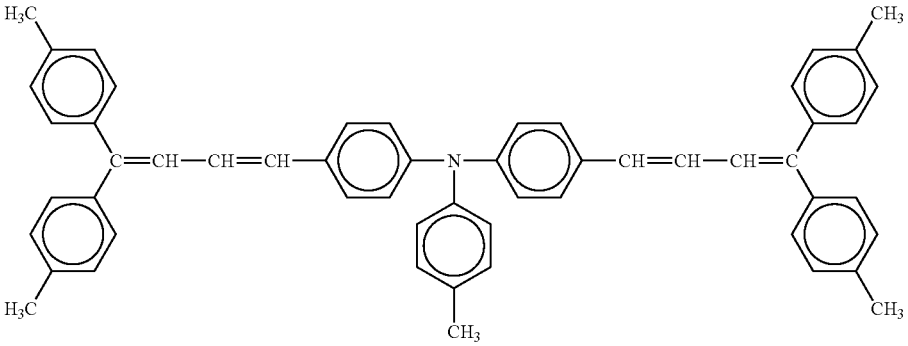

-continued

Formula [VIII]

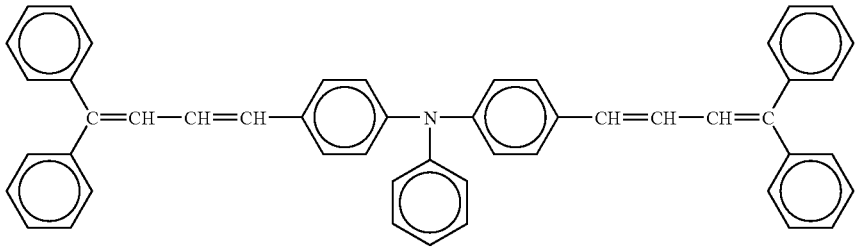

Formula [IX]

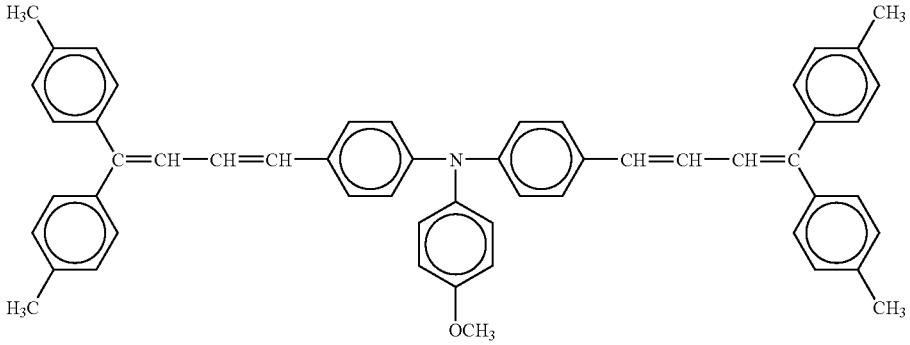

Formula [X]

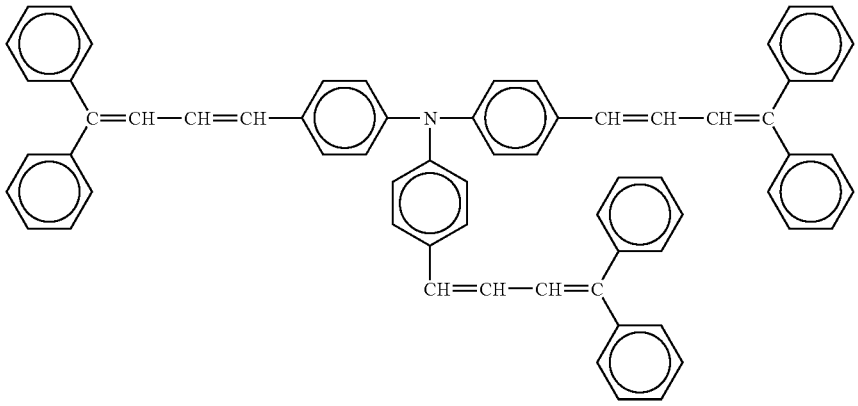

When the compound selected from those of the formula [I] and the compound selected from those of the formula [II] are used simultaneously as the charge transport agents, good characteristics are obtained, which is preferred.

Other charge transport agents than those mentioned above can also be used. The other charge transport agents include polyvinyl carbazole, halogenated polyvinyl carbazole, etc.

Furthermore, other charge transport agents can be added to the photosensitive layer of the electrophotographic photoreceptor of the present invention. In this case, since the sensitivity of the photosensitive layer can be enhanced or the residual potential can be reduced, the characteristics of the electrophotographic photoreceptor of the present invention can be improved.

As the other charge transport agents which can be added for improving the characteristics, there may be used conductive high molecular compounds such as polyvinyl carbazole, halogenated polyvinyl carbazole, polyvinylpyrene, polyvinylindoloquinoxaline, polyvinylbenzothiophene, polyvinylanthracene, polyvinylacridine, polyvinylpyrazoline, polyacetylene, polythiophene, polypyrrole, polyphenylene, polyphenylenevinylene, polyisothianaphthene, polyaniline, polydiacetylene, polyheptadiene, polypyridinediyl, polyquinoline, polyphenylene sulfide, polyferrocenylene, polyperinaphthylene, and polyphthalocyanine.

Moreover, as the charge transport agents, there may also be added low molecular compounds, e.g., polycyclic aromatic compounds such as trinitrofluorenone, tetracyanoethylene, tetracyanoquinodimethane, quinone, diphenoquinone, naphthoquinone, anthraquinone and derivatives thereof, anthracene, pyrene and phenanthrene, nitrogen-containing heterocyclic compounds such as indole, carbazole and imidazole, fluorenone, fluorene, oxadiazole, oxazole, pyrazoline, triphenylmethane, triphenylamine, enamine, stilbene, other butadiene than those mentioned above, other hydrazone compounds than those mentioned above, and the like.

As charge transport agents used for the similar purpose, there may be added high-molecular solid electrolytes obtained by doping high-molecular compounds such as polyethylene oxide, polypropylene oxide, polyacrylonitrile and polymethacrylic acid with a metal ion such as Li (lithium) ion.

As additional charge transport agents used for the similar purpose, there may be used organic charge-transfer complexes comprising an electron donor substance and an electron acceptor substance such as tetrathiafurvalene-tetracyanoquinodimethane.

The desired photoreceptor characteristics can be obtained by using one charge transport agent or two or more charge transport agents as a mixture. The thickness of the charge transport layer is 5.0-50 μm, preferably 10-30 μm.

In the electrophotographic photoreceptor of the present invention, the total thickness of the photosensitive layer is 10-50 μm, preferably 15-25 μm. For example, in case the undercoat layer is provided in a great thickness of about 25 μm, the charge transport layer may be provided in a thin thickness of about 15 μm. On the other hand, in case the undercoat layer is provided in a thin thickness of about 1 μm, the charge transport layer may be provided in a great thickness of about 25 μm.

This is because the photoreceptor is required to have pressure resistance in electrophotographic process using a contact charging means as a charging means. Generally, in the case of a photoreceptor of low pressure resistance, defects occur inside the photoreceptor and on the surface of the photoreceptor due to leakage of current, and the defects appear as defects of image. That is, since the pressure resistance of the photoreceptor is determined by the total thickness of the photoreceptor, when the undercoat layer is thick, the pressure resistance increases and hence the charge transport layer can be thin.

It is preferred for the electrophotographic photoreceptor of the present invention that the photosensitive layer contains an antioxidant or an ultraviolet absorber for inhibiting change of characteristics and occurrence of cracking caused by oxidative deterioration of photoconductive materials or binder resins and for improving mechanical strength.

The antioxidants used in the present invention are preferably monophenols such as 2,6-di-tert-butylphenol, 2,6-di-tert-4-methoxyphenol, 2-tert-buty-4-methoxyphenol, 2,4-dimethyl-6-tert-butylphenol, 2,6-di-tert-butyl-4-methylphenol, butylated hydroxyanisole, stearyl-β-(3,5-di-tert-butyl-4-hydroxyphenyl) propionate, α-tocopherol, β-tocopherol and n-octadecyl-3-(3'-5'-di-tert-butyl-4-hydroxyphenyl)propionate, and polyphenols such as 2,2'-methylenebis(6-tert-butyl-4-methylphenol), 4,4'-butylidene-bis-(3-methyl-6-tert-butylphenol), 4,4'-thiobis(6-tert-butyl-3-methylphenol), 1,1,3-tris(2-methyl-4-hydroxy-5-tert-butylphenyl)butane, 1,3,5-trimethyl-2,4,6-tris(3,5-di-tert-butyl-4-hydroxybenzyl)benzene and tetrakis[methylene-3(3,5-di-tert-butyl-4-hydroxyphenyl)propionate]methane. These can be contained in the photosensitive layer each alone or in combination of two or more.

The ultraviolet absorbers are preferably benzotriazole-based absorbers such as 2-(5-methyl-2-hydroxyphenyl)benzotriazole, 2-[2-hydroxy-3,5-bis(α,α-dimethylbenzyl)phenyl]-2H-benzotriazole, 2-(3,5-di-tert-butyl-2-hydroxyphenyl)benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenyl)benzotriazole and 2-(2'-hydroxy-5'-tert-octylphenyl)benzotriazole, and salicylic acid-based absorbers such as phenyl salicylate, p-tert-butylphenyl salicylate and p-octylphenyl salicylate. These can be contained in the photosensitive layer each alone or in combination of two or more.

The antioxidant and the ultraviolet absorber can be simultaneously added. These can be added to any layer in the photosensitive layer, but it is preferred to add them to the outermost surface layer, particularly, the charge transport layer.

The amount of the antioxidant added is preferably 3-20% by weight based on the binder resin, and that of the ultraviolet absorber is preferably 3-30% by weight based on the binder resin. When both the antioxidant and the ultraviolet absorber are added together, the total amount of them is preferably 5-40% by weight based on the binder resin.

In addition to the antioxidant and the ultraviolet absorber, there may be added light stabilizers such as hindered amines and hindered phenols, aging inhibitors such as diphenylamine compounds, surface active agents, etc. to the photosensitive layer.

The general method for forming the photosensitive layer comprises dispersing or dissolving a given photosensitive material and a given binder resin together in a solvent to prepare a coating solution and coating the solution on a given substrate.

The coating solution can be coated, depending on the shape of the substrate or state of the coating solution, by dip coating, curtain flow coating, bar coating, roll coating, ring coating, spin coating, spray coating, etc.

The charge generation layer can also be formed by vacuum deposition method.

The solvents used for coating solution include, for example, alcohols such as methanol, ethanol, n-propanol, i-propanol, butanol, methyl cellosolve and ethyl cellosolve, saturated aliphatic hydrocarbons such as pentane, hexane, heptane, octane, cyclohexane and cycloheptane, aromatic hydrocarbons such as toluene and xylene, chlorine-containing hydrocarbons such as dichloromethane, dichloroethane, chloroform and chlorobenzene, ethers such as dimethyl ether, diethyl ether and tetrahydrofuran (THF), ketones such as acetone, methyl ethyl ketone, methyl isobutyl ketone and cyclohexanone, esters such as ethyl formate, propyl formate, methyl acetate, ethyl acetate, propyl acetate, butyl acetate and methyl propionate, and amides such as N,N-dimethylformamide, dimethyl sulfoxide and N-methyl-2-pyrrolidone. These may be used each alone or in admixture of two or more.

Furthermore, an intermediate layer comprising a resin in which a metal compound, metal oxide, carbon, silica, resin powder or the like is dispersed can be used for the undercoat layer. Moreover, it may contain various pigments, electron acceptor substances, electron donor substances or the like for improvement of characteristics.

In addition, there may be formed a surface protective layer on the surface of the photosensitive layer by forming an organic thin film of polyvinyl formal resin, polycarbonate resin, fluorocarbon resin, polyurethane resin, silicone resin or the like or a thin film comprising a siloxane structure formed by a hydrolyzate of silane coupling agent, and, in this case, endurance of the photoreceptor is improved, which is preferred. The surface protective layer may be provided for improving functions other than the endurance.

Next, the electrophotographic process and electrophotographic apparatus of the present invention will be explained. For the electrophotographic process of the present invention, there may be used known means such as charging means, exposing means, developing means, transferring means, fixing means and cleaning means. For the charging means, a non-contact charging system such as corona charging system, and a contact charging system such as charging roller or charging brush can be used. As the light source for imagewise exposing means, there can be used halogen lamp, fluorescent lamp, laser beams, etc. The wavelength of semiconductor laser is 780 nm or less, preferably 780-500 nm, and in this case, there may be employed such a method as of narrowing the diameter of laser beam. The developing means includes any of dry developing method, wet developing method, two component developing method, one component developing method, and magnetic/non-magnetic developing method. The transfer means may be either roller or belt.

EXAMPLE

Examples and comparative examples of the electrophotographic photoreceptor according to the present invention will be explained in detail below.

Example 1

A mixture comprising titanium oxide particles coated with alumina and a polyimide resin represented by the formula [III] in which X is [X−1] at a weight ratio of 1:1 was coated on a cylindrical drum of 30 mm in diameter comprising aluminum and subjected to no cutting process, followed by drying at 140° C. for 30 minutes to form a first undercoat layer of 20.0 μm in thickness. Then, on the first undercoat layer was coated a coating solution prepared by dissolving a melamine-alkyd resin as a thermosetting resin and titanium oxide at a ratio of 1:3 in methyl ethyl ketone to laminate a second undercoat layer having a thickness of 18.0 μm on the first undercoat layer.

Then, thereon was coated a dispersion of oxytitanium phthalocyanine having a maximum peak at an X-ray diffraction intensity of 7.5° with using polyvinyl butyral as a binder resin by dip coating to form a charge generation layer of 0.1 μm in thickness.

Then, a coating solution was prepared by dissolving a polycarbonate copolymer as a binder resin, a butadiene compound of the formula [VI] as a charge transport agent and 2,6-di-tert-butyl-4-methylphenol as an antioxidant at a weight ratio of polycarbonate copolymer/butadiene compound/antioxidant=1.0/0.8/0.18 in tetrahydrofuran.

The resulting coating solution was coated by dip coating, followed by drying at 100° C. for 1 hour to form a charge transport layer of 20 μm in thickness, thereby obtaining an electrophotographic photoreceptor.

Example 2

An electrophotographic photoreceptor was prepared in the same manner as in Example 1, except that the weight ratio of polyimide resin and titanium oxide in the first undercoat layer was changed to 2:1.

Example 3

An electrophotographic photoreceptor was prepared in the same manner as in Example 1, except that the cylindrical drum comprising aluminum and subjected to no cutting process was changed to a cylindrical drum comprising aluminum and subjected cutting process and CP processing.

Example 4

An electrophotographic photoreceptor was prepared in the same manner as in Example 1, except that the weight ratio of polyimide resin and titanium oxide in the first undercoat layer was changed to 1:4.

Example 5

An electrophotographic photoreceptor was prepared in the same manner as in Example 1, except that the thickness of the first undercoat layer was changed to 1.0 μm.

Example 6

An electrophotographic photoreceptor was prepared in the same manner as in Example 1, except that the thickness of the first undercoat layer was changed to 5.0 μm.

Example 7

An electrophotographic photoreceptor was prepared in the same manner as in Example 1, except that the thickness of the first undercoat layer was changed to 30.0 μm.

Example 8

An electrophotographic photoreceptor was prepared in the same manner as in Example 1, except that the thickness of the first undercoat layer was changed to 50.0 μm.

Example 9

An electrophotographic photoreceptor was prepared in the same manner as in Example 1, except that the melamine-alkyd resin in the second undercoat layer was changed to nylon resin.

Example 10

An electrophotographic photoreceptor was prepared in the same manner as in Example 1, except that the second undercoat layer was omitted.

Example 11

An electrophotographic photoreceptor was prepared in the same manner as in Example 1, except that the charge transport agent of the formula [VI] used in Example 1 was changed to that of the formula [VII].

Example 12

An electrophotographic photoreceptor was prepared in the same manner as in Example 1, except that a mixture of the charge transport agent of the formula [VI] and that of the formula [VII] was used.

Example 13

An electrophotographic photoreceptor was prepared in the same manner as in Example 1, except that the charge generation agent was changed to a charge generation agent having a maximum peak at an X-ray diffraction intensity of 27.3°.

Example 14

An electrophotographic photoreceptor was prepared in the same manner as in Example 1, except that the titanium oxide in the first undercoat layer was not used and the second undercoat layer was omitted.

Example 15

An electrophotographic photoreceptor was prepared in the same manner as in Example 1, except that the titanium oxide in the first undercoat layer was not used.

Example 16

An electrophotographic photoreceptor was prepared in the same manner as in Example 1, except that the thickness of the first undercoat layer was changed to 0.5 μm.

Comparative Example 1

An electrophotographic photoreceptor was prepared in the same manner as in Example 1, except that an Alumite layer was formed by anodizing treatment in place of the undercoat layer formed in Example 1.

Comparative Example 2

An electrophotographic photoreceptor was prepared in the same manner as in Example 1, except that the first undercoat layer was omitted.

Comparative Example 3

An electrophotographic photoreceptor was prepared in the same manner as in Example 1, except that the first undercoat layer and the second undercoat layer were omitted.

Comparative Example 4

An electrophotographic photoreceptor was prepared in the same manner as in Example 1, except that a hydrazone compound represented by the following formula [A] was used in place of the charge transport agent represented by the formula [VI].

Formula [A]

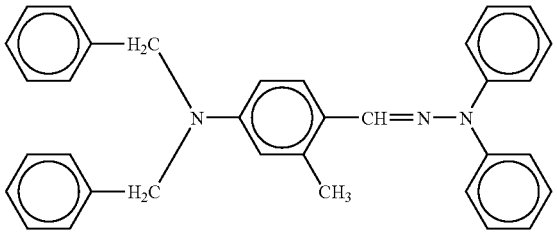

Evaluation Method

[Measurement of Electrostatic Characteristics, Repeated Cycling Test, Image Test]

The cylindrical electrophotographic photoreceptors prepared in Examples 1-16 and Comparative Examples 1-4 were charged using a direct charging type Microline 14 printer manufactured by Oki Data Co., Ltd. in an environment of normal temperature and humidity (24° C., 40% RH) so that the surface potential of the photoreceptor after charged was −800 V, and were subjected to initial setting so that the surface potential of the photoreceptors after exposed by LED was −50 V. After printing of 20,000 copies of A4 size, the surface potential V0 (−V) and the residual potential VR (−V) were measured. The image test was conducted by evaluating the images after continuous printing of 20,000 copies. The results are shown in Table 1. In Table 1, the mark "○" means that image was good in quality and "x" means that image was defective and practically unacceptable.

TABLE 1

| | After printing of 20,000 copies | | Image after printing of 20,000 copies | | | | |
|---|---|---|---|---|---|---|---|
| | Surface potential (−V) | Potential after exposure (−V) | Leakage | Transfer memory | Dusts, fogs | Reduction of density | Black points |
| Example 1 | 795 | 50 | ○ | ○ | ○ | ○ | ○ |
| Example 2 | 790 | 52 | ○ | ○ | ○ | ○ | ○ |
| Example 3 | 790 | 52 | ○ | ○ | ○ | ○ | ○ |
| Example 4 | 795 | 52 | ○ | ○ | ○ | ○ | ○ |
| Example 5 | 790 | 48 | ○ | ○ | ○ | ○ | ○ |
| Example 6 | 795 | 50 | ○ | ○ | ○ | ○ | ○ |
| Example 7 | 790 | 52 | ○ | ○ | ○ | ○ | ○ |
| Example 8 | 760 | 55 | ○ | ○ | ○ | ○ | ○ |
| Example 9 | 790 | 52 | ○ | ○ | ○ | ○ | ○ |
| Example 10 | 795 | 56 | ○ | ○ | ○ | ○ | ○ |
| Example 11 | 790 | 40 | ○ | ○ | ○ | ○ | ○ |
| Example 12 | 920 | 45 | ○ | ○ | ○ | ○ | ○ |
| Example 13 | 950 | 55 | ○ | ○ | ○ | ○ | ○ |
| Example 14 | 920 | 680 | ○ | ○ | ○ | x | ○ |
| Example 15 | 950 | 720 | ○ | ○ | ○ | x | ○ |
| Example 16 | 790 | 45 | x | ○ | ○ | ○ | x |
| Comparative Example 1 | 785 | 52 | ○ | x | ○ | ○ | ○ |
| Comparative Example 2 | 785 | 50 | x | ○ | ○ | ○ | x |
| Comparative Example 3 | 750 | 48 | x | x | x | ○ | x |
| Comparative Example 4 | 750 | 52 | x | x | x | ○ | x |

As is clear from Table 1, the electrophotographic photoreceptors of Examples 1-16 were satisfactory in chargeability and less in light-induced fatigue even after repeated printing of 20,000 copies, and, furthermore, there occurred no defects in the resulting images such as dusts and fogs.

In addition, good results were also obtained when titanium oxide was added to the polyimide resin or thermosetting resin or thermoplastic resin was laminated on the polyimide resin layer.

That is, the results were particularly superior in Examples 1-16.

On the other hand, in case the polyimide resin layer was not present in Comparative Examples 2 and 3, black points due to transfer memory, and dusts and fogs occurred.

The invention claimed is:

1. An electrophotographic photoreceptor comprising a conductive support and a photosensitive layer formed on the conductive support, with an undercoat layer provided between the support and the photosensitive layer, characterized in that the undercoat layer has a two-layer structure comprising a first layer which contains a polyimide resin represented by the formula [III] and a second layer containing a thermosetting resin or a thermoplastic resin formed on the first layer, and the photosensitive layer contains at least one of the compounds represented by the following formula [I] and [II] (excluding 1-p-dibenzylaminophenyl-1-p-diethylaminophenyl-4,4-diphenyl-1,3-butadiene) as a charge transport agent:

Formula [I]

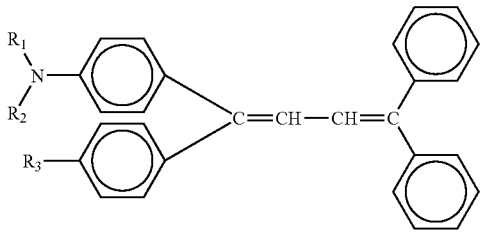

(in the above formula, $R_1$ and $R_2$ independently represent an alkyl group having 1-6 carbon atoms which may have a substituent, and $R_3$ represents a hydrogen atom or a dialkylamino group in which at least one alkyl group has 2 or more carbon atoms), Formula [II]

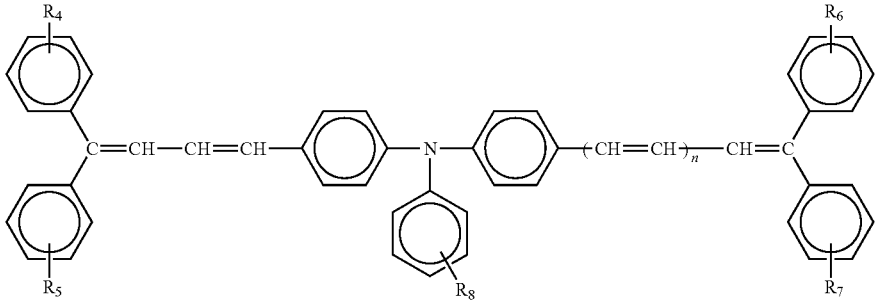

(in the above formula, $R_4$—$R_7$ may be the same or different and independently represent a hydrogen atom, a halogen atom, a alkyl group or alkoxy group having 1-6 carbon atoms or an aryl group which may have a substituent, $R_8$ represents a hydrogen atom, a halogen atom, an alkyl group or alkoxy group having 1-6 carbon atoms, an aryl group which may have a substituent, an alkenyl group or alkadienyl group which may have a substituent or a group represented by the formula [II'], ad n represents a integer of 0 or 1), Formula [II']

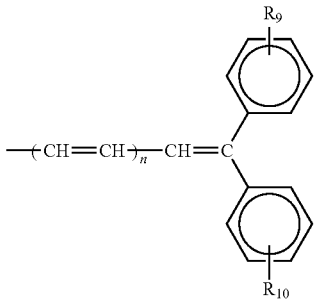

(in the above formula, $R_9$ and $R_{10}$ may be the same or different ad independently represent a hydrogen atom, a halogen atom, an alkyl group or alkoxy group having 1-6 carbon atoms or an aryl group which may have a substituent, and n represents an integer of 0 or 1), Formula [III]

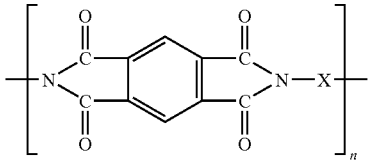

(in the above formula, X is a divalent polycyclic aromatic group in which the aromatic rings may be linked by a heteroatom and n is an integer which shows a polymerization degree).

2. An electrophotographic photoreceptor according to claim 1, wherein to first layer has a thickness of 1.0-50 μm.

3. An electrophotographic apparatus comprising the photoreceptor of claim 2 and a contact charging unit.

4. An electrophotographic apparatus comprising the photoreceptor of claim 2 and an exposing unit including a semiconductor laser.

5. An electrophotographic photoreceptor according to claim 1, wherein the first layer contains titanium oxide, and the weight ratio of the polyimide resin and the titanium oxide is in the range of 2:1-1:4.

6. An electrophotographic apparatus comprising the photoreceptor of claim 5 and a contact charging unit.

7. An electrophotographic apparatus comprising the photoreceptor of claim 5 and an exposing unit including a semiconductor laser.

8. An electrophotographic photoreceptor according to claim 1, wherein the conductive support is a tube subjected to no cutting process.

9. An electrophotographic apparatus comprising the photoreceptor of claim 1 and a contact charging unit.

10. An electrophotographic apparatus comprising the photoreceptor of claim 1 and an exposing unit including a semiconductor laser.

11. An electrophotographic photoreceptor according to claim 1, wherein the first layer has a thickness of 5.0-50 μm.

12. An electrophotographic photoreceptor according to claim 1, wherein the first layer has a thickness of 30-50 μm.

* * * * *